US008356426B1

(12) United States Patent
Daniel et al.

(10) Patent No.: US 8,356,426 B1
(45) Date of Patent: Jan. 22, 2013

(54) ARTICLE OF FOOTWEAR

(75) Inventors: Isaac Sayo Daniel, Miami, FL (US); Yusef S. El, Brooklyn, NY (US)

(73) Assignee: F3M3 Companies, Inc., Miramar, FL (US)

( * ) Notice: Subject to any disclaimer, the term of this patent is extended or adjusted under 35 U.S.C. 154(b) by 354 days.

(21) Appl. No.: 12/635,428

(22) Filed: Dec. 10, 2009

(51) Int. Cl.
*A43C 15/00* (2006.01)

(52) U.S. Cl. ..... 36/15; 36/100

(58) Field of Classification Search ..... 36/15, 100, 36/101, 33, 31
See application file for complete search history.

(56) References Cited

U.S. PATENT DOCUMENTS

| | | | | | |
|---|---|---|---|---|---|
| 80,037 | A | * | 7/1868 | Van Ausdall | 36/31 |
| 680,868 | A | * | 8/1901 | Leadbeater | 36/15 |
| 740,311 | A | * | 9/1903 | Pratt | 36/31 |
| 1,148,584 | A | * | 8/1915 | Gerrish | 156/258 |
| 2,290,390 | A | * | 7/1942 | Stewart | 36/33 |
| 2,435,668 | A | * | 2/1948 | Behringer et al. | 36/11.5 |
| 2,478,664 | A | * | 8/1949 | Morrow et al. | 36/31 |
| 2,669,036 | A | * | 2/1954 | Israel | 36/11.5 |
| 3,121,962 | A | * | 2/1964 | Gullo | 36/11.5 |
| 3,538,628 | A | * | 11/1970 | Einstein, Jr. | 36/15 |
| 4,103,440 | A | | 8/1978 | Lawrence | |
| 4,745,693 | A | | 5/1988 | Brown | |
| 4,887,369 | A | * | 12/1989 | Bailey et al. | 36/101 |
| 5,317,822 | A | | 6/1994 | Johnson | |
| 5,353,522 | A | | 10/1994 | Wagner | |
| 6,065,228 | A | * | 5/2000 | Begey et al. | 36/15 |
| 6,345,454 | B1 | | 2/2002 | Cotton | |
| 6,442,869 | B2 | * | 9/2002 | Coomes | 36/11.5 |
| 6,598,324 | B1 | * | 7/2003 | Tsuji | 36/130 |
| 6,662,476 | B1 | * | 12/2003 | Lind | 36/130 |
| 7,246,453 | B2 | * | 7/2007 | Kim | 36/15 |
| 7,434,335 | B2 | * | 10/2008 | Feldstein | 36/8.3 |
| 7,866,064 | B2 | * | 1/2011 | Gerber | 36/62 |
| 8,215,037 | B2 | * | 7/2012 | James | 36/103 |
| 2002/0178613 | A1 | * | 12/2002 | Williamson et al. | 36/15 |
| 2003/0230007 | A1 | * | 12/2003 | Walton | 36/15 |
| 2005/0115117 | A1 | * | 6/2005 | Morlin | 36/117.3 |

* cited by examiner

*Primary Examiner* — Marie Patterson
(74) *Attorney, Agent, or Firm* — Alberto Interian, III, Esq.

(57) ABSTRACT

A kit comprising at least one shoe and at least one detachable sole section. An article of footwear comprising a shoe and at least one means for connecting the shoe to at least one detachable sole section. An apparatus comprising at least one detachable sole section.

12 Claims, 9 Drawing Sheets

ARTICLE OF FOOTWEAR

FIELD

The present disclosure relates generally to articles of footwear, and more particularly, to apparatuses and various other disclosures related to shoes and shoe components, such as midsoles and soles.

BACKGROUND

In general, footwear, and more specifically, shoes, come in all shapes and sizes, and are used for a variety of different activities. For example, there are shoes for formal wear, such as men's dress shoes, and ladies' heels, and there are shoes for casual wear, such as sneakers and the like.

Additionally, there are shoes that are specifically made for a particular activity, such as a sport. There are many different types of sport shoes, including tennis shoes, basketball shoes, rock climbing shoes, and some of these types of athletic shoes are used on grass, and thus include cleats, such as football, baseball, soccer, and golf shoes.

Traditionally, shoes are made up of three components, an upper, which is the top and usually largest part of the shoe. The upper is the part of the shoe that the user would insert their foot into and possibly lace it closed. The next component would be the midsole, which is located directly beneath the upper, and usually contains some sort of shock absorbing and/or supporting material. The midsole also serve as the mounting surface for the outsole, the third component of a typical shoe. The outsole is the part of the shoe that comes into direct contact with the ground, and is usually made of a tough material. Some outsoles include cleats to allow a user to gain traction in soft surfaces, such as grass and mud.

Depending on the purpose for which a shoe will be used, the geometry and makeup of each component of the shoe will vary. For example, a basketball shoe typically has a high top upper, to allow for ankle support, and flat outsole to allow for maximum traction on a hard and flat surface.

Thus far, the various components of a shoe, namely the upper, midsole, and outsole, have been permanently attached together by means such as stitching, glue, tape, staples, and the like. Such a fabrication has limited each shoe's usability to a single purpose, and has thereby forced consumers to purchase several different shoes, each for its own purpose, which can be impractical and costly. Although there have been some forms of replaceable soles, the surface of such soles have been limited to one specific geometry and material make up, and thus have limited customization capabilities.

Also, traditional soles, including replaceable soles, have been formed of a single piece, which forces a user to have to replace the entire sole when only a part of it has worn out. This is impractical and wasteful, since it is very common for certain parts of a sole to wear out more than others throughout the life of a sole.

SUMMARY

The various apparatuses and other embodiments disclosed herein result from the realization that shoes can be made more useful, cost effective, longer lasting, and versatile by providing a shoe with a detachable sole, wherein the detachable shoe is comprised of at least one detachable shoe section, whereby different types of soles can be attached to a shoe.

The various apparatuses and other embodiments disclosed herein result from the further realization that detachable shoe soles can be made more customizable, cost effective, longer lasting, useful, and versatile by providing at least one, if not a plurality of detachable shoe sole sections, each capable of having its own surface geometry and material make up.

Accordingly, the various embodiments and disclosures described herein solve the limitations of the prior art in a new and novel manner.

DETAILED DESCRIPTION OF PREFERRED EMBODIMENTS

Figure 1:
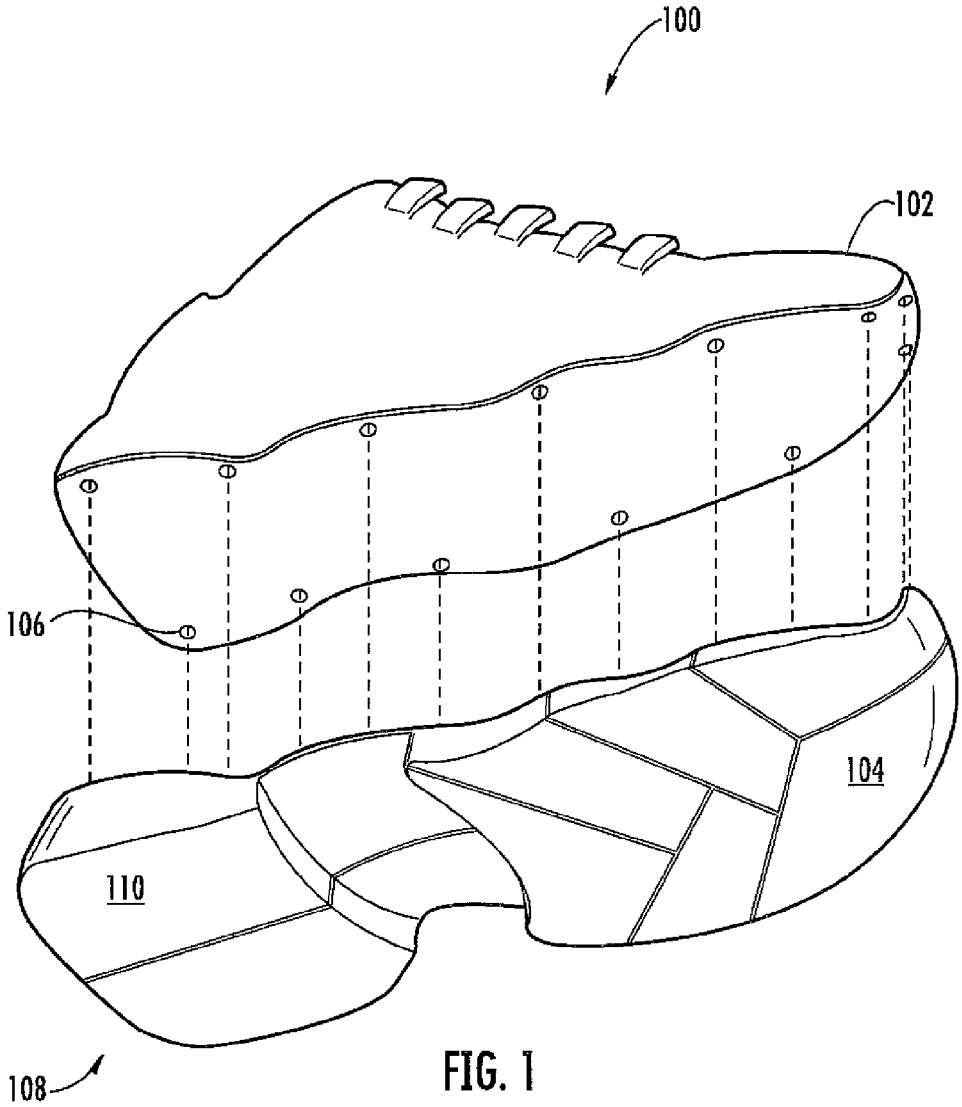
FIG. 1 shows a kit in accordance with one embodiment.
Figure 4:
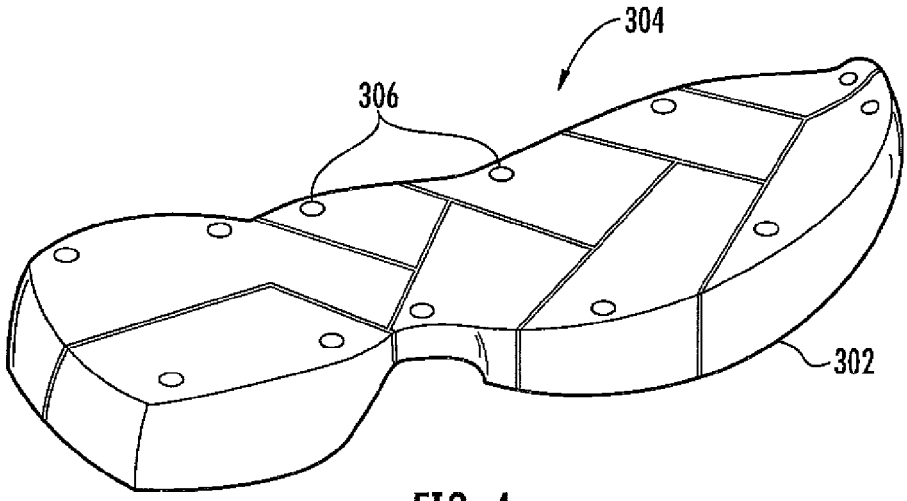
FIG. 4 shows an apparatus in accordance with another embodiment.
Figure 5:
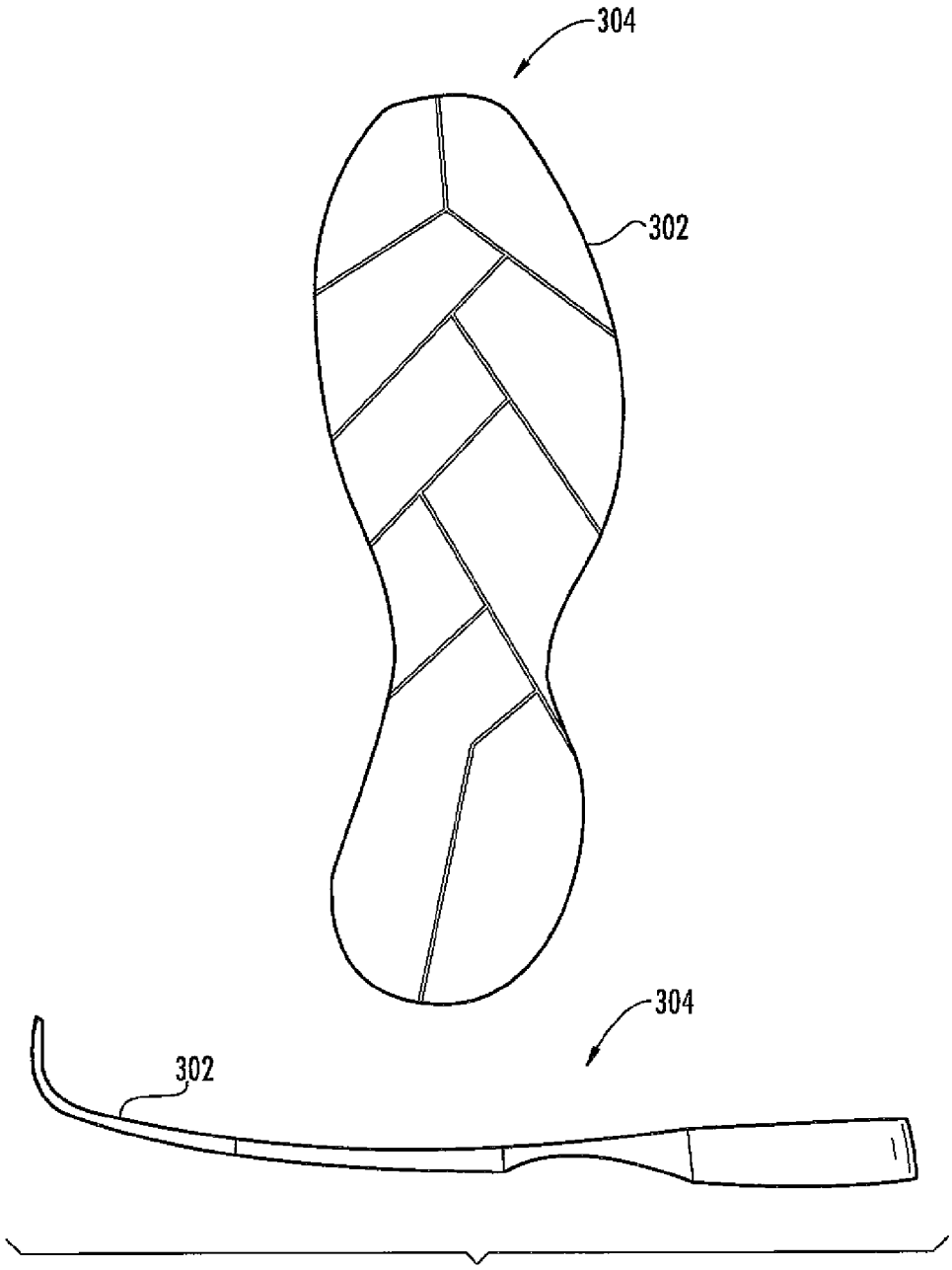
FIG. 5 shows an apparatus in accordance with yet another embodiment.
Figure 6:
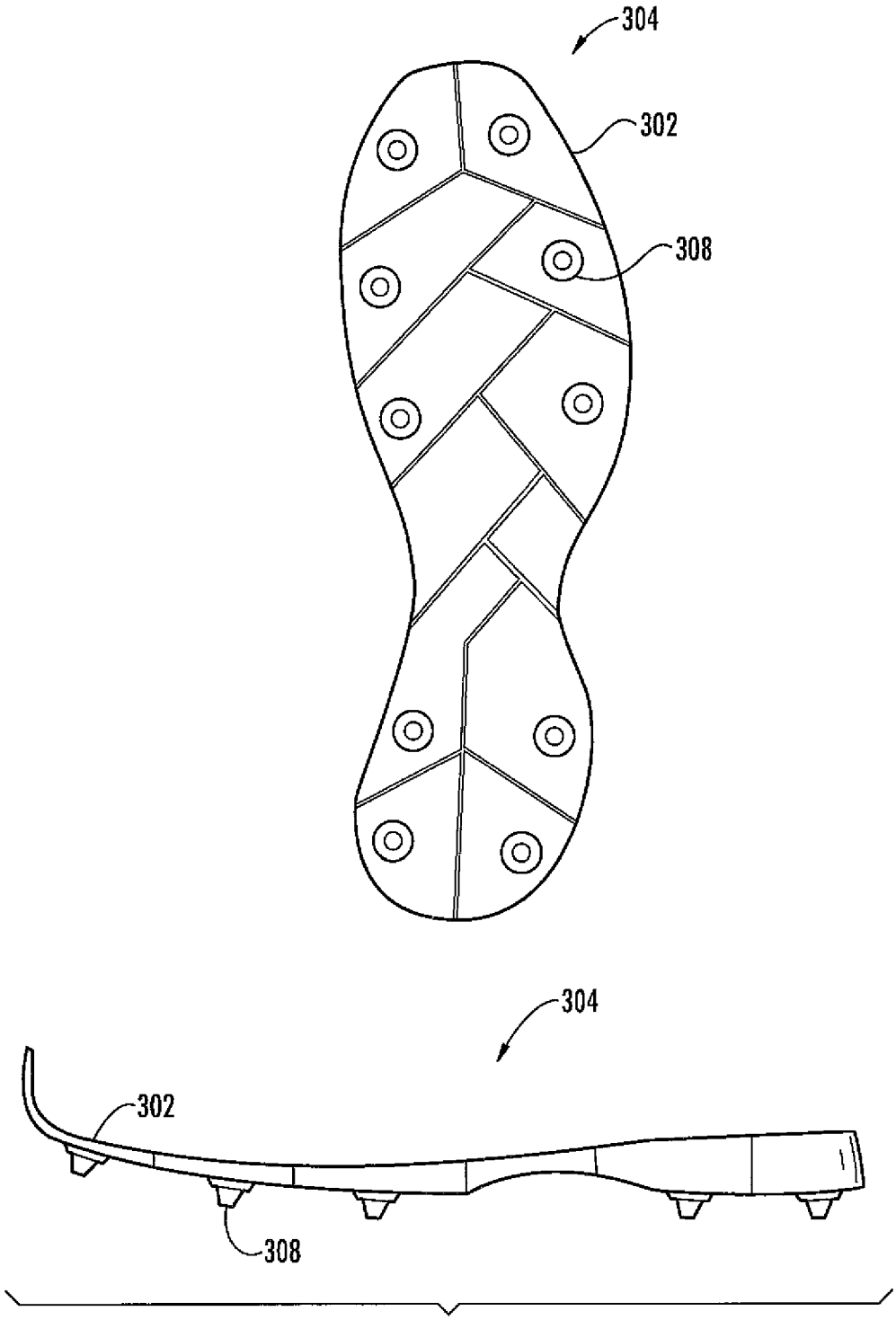
FIG. 6 shows an apparatus in accordance with a further embodiment.

FIG. 1 shows a kit 100 in accordance with one embodiment. Kit 100 comprises a shoe 102 and at least one detachable sole section 104. Shoe 102 may comprise an upper and a midsole, while detachable sole section 104 (as shown in FIGS. 4 through 6, with reference to numeral 302) may comprise an outsole. Alternatively, shoe 102 may comprise an upper, while detachable sole section 104 may comprise a midsole and an outsole.

In some embodiments, shoe 102 may be a high top shoe, a mid top shoe, and/or a low top shoe. In further embodiments, shoe 102 may be any kind of shoe, such as, but not limited to, a dress shoe, a casual shoe, a sandal, a sneaker, an athletic shoe, including, but not limited to, a running shoe, a walking shoe, a cycling shoe, a basketball shoe, a tennis shoe, a football shoe, an outdoor soccer shoe, an indoor soccer shoe, a baseball shoe, a dance shoe, a bowling shoe, a skateboarding shoe, a snow shoe, a mountain climbing shoe, a track shoe, a wrestling shoe, a hiking shoe, and the like.

In yet another embodiment, detachable sole section 104 may include any type of sole pattern, including, but not limited to, a dress shoe sole, a casual shoe sole, a sandal sole, a sneaker sole, an athletic shoe sole, including, but not limited to, a running shoe sole, a walking shoe sole, a cycling shoe sole, a basketball shoe sole, a tennis shoe sole, a football shoe sole, an outdoor soccer shoe sole, an indoor soccer shoe sole, a baseball shoe sole, a dance shoe sole, a bowling shoe sole, a skateboarding shoe sole, a snow shoe sole, a mountain climbing shoe sole, a track shoe sole, a wrestling shoe sole, a hiking shoe sole, and the like.

Accordingly, detachable sole section 104 may be formed of any suitable material, including rubber, resin, leather, composite materials, and the like. Detachable sole section 104 may have any kind of surface geometry, such as, but not limited to, a flat surface, a rough surface, a grooved surface, and the like.

Figure 3A:
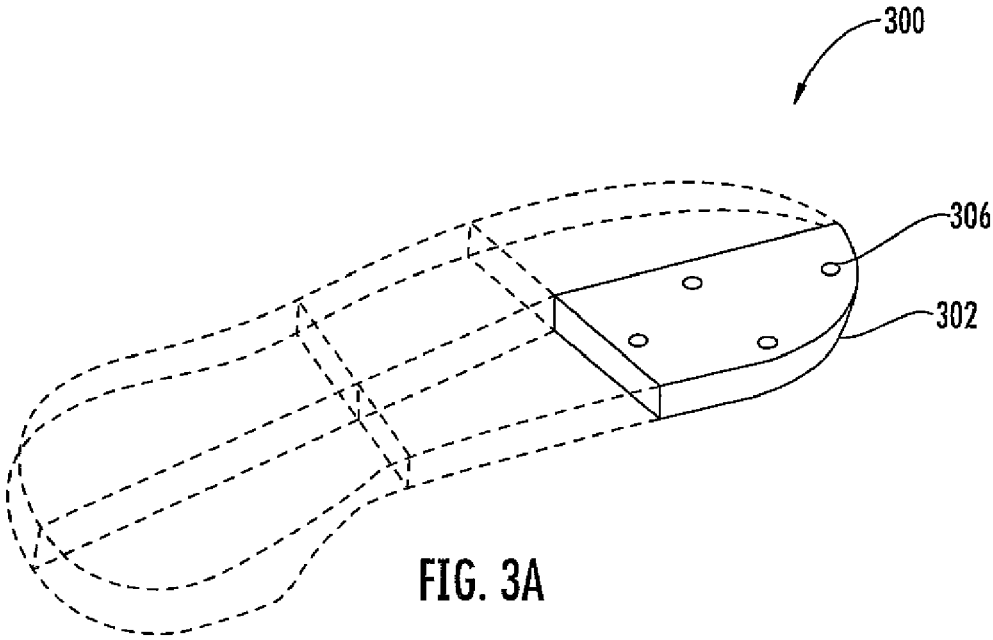
FIGS. 3A and 3B show an apparatus in accordance with one embodiment.
Figure 3B:
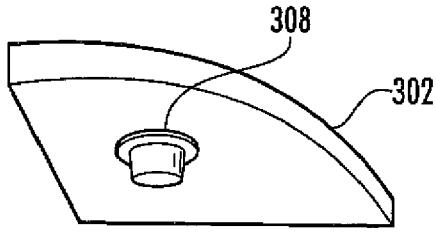

In a further embodiment, detachable sole section 104 may include at least one cleat thereon (as shown in FIGS. 3B and 6 with reference to numeral 308). The cleat maybe any kind of cleat, including, but not limited to, a golf cleat, a soccer cleat, a football cleat, a baseball cleat, a track cleat, a hiking cleat, and the like.

In a further embodiment, kit 100 may further comprise at least one detachable sole 108 (also shown in FIGS. 4 through 6, with reference to numeral 302), wherein detachable sole 108 is comprised of at least one, if not a plurality of detachable sole section 110, which may include detachable sole section 104. In some embodiments, each detachable sole section 110 may be made of a different material and have a different surface geometry, and may include at least one cleat, as described above. In some embodiments, a user may interchange different detachable sole sections to configure customized shoe sole. In such embodiments, a user may decide to arrange a sole with cleats only on certain portions of the sole, or different surface geometries on different portions of the sole to obtain unique performance properties, which may be suitable to different kinds of surfaces. In some embodiments, a user may interchange different detachable sole sections to configure a customized shoe sole. In such embodiments, a user may decide to arrange a sole with cleats only on certain portions of the sole, different surface geometries on certain portions of the sole, and/or different materials on different portions of the sole to obtain unique performance properties, which may be suitable for different kinds of surfaces. In other embodiments, a user may replace a worn out detachable sole portion with a new portion.

In yet a further embodiment, kit 100 may further comprise a means for connecting 106 shoe 102 to detachable sole section 104. In some embodiments, means for connecting 106 may be positioned on shoe 102 and/or detachable sole section 104. In other embodiments, means for connecting 106 may be independent, e.g. not connected, to either shoe 102 or detachable sole section 104.

Means for connecting 106 may be any kind of means for connecting two objects, such as, but not limited to, zippers, magnets, clips, suction cups, rods, screws, tacks, nails, hooks and loops fasteners, sticky tack, and the like. Please refer to FIGS. 7A through 8B, along with the corresponding description for various embodiments of connecting means that may be used along with kit 100.

In a further embodiment, kit 100 may include a stabilizer (not shown), wherein the stabilizer may be connected to sole section 104 and/or shoe 102. In some embodiments, the stabilizer may be a U-shaped component positioned below the heel portion of shoe 102. In another embodiment, the stabilizer may act as a hinge by having a bottom portion that extends along the bottom part of shoe 102, and another portion, which is connected to the bottom portion, extending and supporting the heel portion of shoe 102. In one embodiment, the stabilizer may be positioned between the midsole and upper of shoe 102, while in another embodiment, the stabilizer may be positioned below the midsole. In yet another embodiment, the stabilizer may be positioned on and/or in sole section 104. The stabilizer may be made of any sufficiently hard and flexible material, such as, but not limited to, plastic, resin, carbon fiber, fiberglass, metal, and the like.

Figure 2:
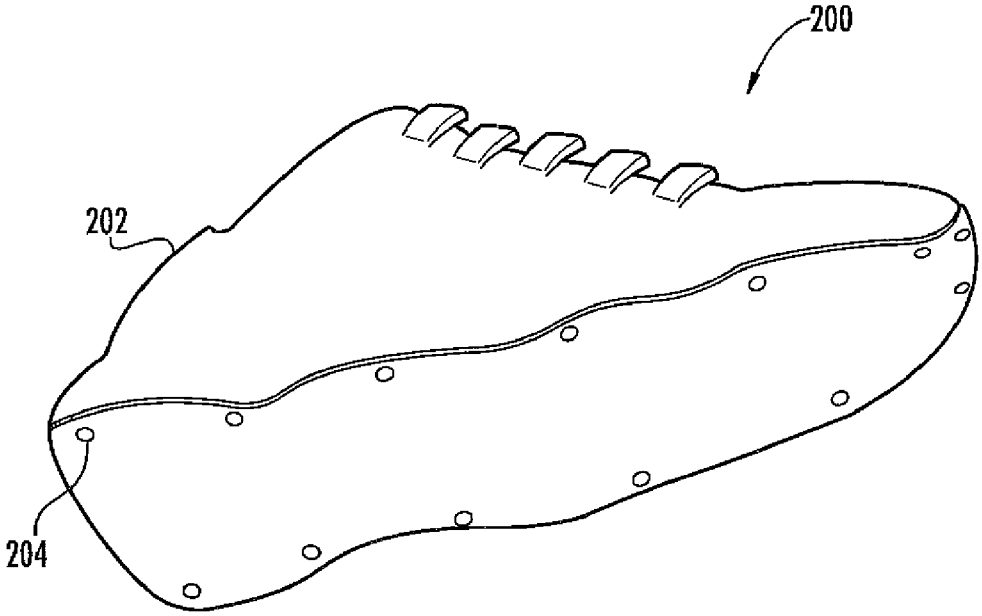
FIG. 2 shows an article of footwear in accordance with one embodiment.

Referring now to FIG. 2, an article of footwear 200 is shown in accordance with one embodiment. Article of footwear 200 may comprise a shoe 202 and at least one means for connecting 204 the shoe to at least one detachable sole section (as shown in FIGS. 3A through 6, with reference to numeral 302)

Means for connecting 204 may be any kind of means for connecting two objects, such as, but not limited to, zippers, magnets, clips, suction cups, rods, screws, tacks, nails, hooks and loops fasteners, sticky tack, and the like. Please refer to FIGS. 7A through 8B, along with the corresponding description for various embodiments of connecting means that may be used along with article of footwear 200. In some embodiments, means for connecting 204 may be positioned on shoe 202 and/or the detachable sole section (not shown). In other embodiments, means for connecting 204 may be independent, e.g. not connected, to either shoe 202 or the detachable sole section.

In some embodiments, shoe 202 may be a high top shoe, a mid top shoe, and/or a low top shoe. In further embodiments, shoe 202 may be any kind of shoe, such as, but not limited to, a dress shoe, a casual shoe, a sandal, a sneaker, an athletic shoe, including, but not limited to, a running shoe, a walking shoe, a cycling shoe, a basketball shoe, a tennis shoe, a football shoe, an outdoor soccer shoe, an indoor soccer shoe, a baseball shoe, a dance shoe, a bowling shoe, a skateboarding shoe, a snow shoe, a mountain climbing shoe, a track shoe, a wrestling shoe, a hiking shoe, and the like.

In yet a further embodiment, article of footwear 200 may comprise at least one detachable sole section connected to shoe 202 (as shown in FIGS. 3A through 6, with reference to numeral 302). The detachable sole section may include any type of sole pattern, including, but not limited to, a dress shoe sole, a casual shoe sole, a sandal sole, a sneaker sole, an athletic shoe sole, including, but not limited to, a running shoe sole, a walking shoe sole, a cycling shoe sole, a basketball shoe sole, a tennis shoe sole, a football shoe sole, an outdoor soccer shoe sole, an indoor soccer shoe sole, a baseball shoe sole, a dance shoe sole, a bowling shoe sole, a skateboarding shoe sole, a snow shoe sole, a mountain climbing shoe sole, a track shoe sole, a wrestling shoe sole, a hiking shoe sole, and the like. The detachable sole section may include at least one cleat (as shown in FIGS. 3B and 6 with reference to numeral 308), which may include, but is not limited to, a golf cleat, a baseball cleat, a football cleat, a cricket cleat, a track shoe cleat, and the like.

FIGS. 3A and 3B show an apparatus 300 in accordance with one embodiment. Apparatus 300 may comprise at least one detachable sole section 302. Detachable sole section 302 may include any type of sole pattern, including, but not limited to, a dress shoe sole, a casual shoe sole, a sandal sole, a sneaker sole, an athletic shoe sole, including, but not limited to, a running shoe sole, a walking shoe sole, a cycling shoe sole, a basketball shoe sole, a tennis shoe sole, a football shoe sole, an outdoor soccer shoe sole, an indoor soccer shoe sole, a baseball shoe sole, a dance shoe sole, a bowling shoe sole, a skateboarding shoe sole, a snow shoe sole, a mountain climbing shoe sole, a track shoe sole, a wrestling shoe sole, a hiking shoe sole, and the like. Detachable sole section 302 may include at least one cleat 308 (as shown in FIGS. 3B and 6, with reference to numeral 308), which may include, but is not limited to, a golf cleat, a baseball cleat, a football cleat, a cricket cleat, a track shoe cleat, and the like.

In some embodiments, detachable sole section 302 may be used in conjunction with a plurality of other detachable sole sections to form an entire detachable sole 304, as shown in FIGS. 4 through 6. In some embodiments, each detachable sole section 302 may be made of a different material and have a different surface geometry, and may include at least one cleat, as shown in FIGS. 3B and 6. In some embodiments, a user may interchange different detachable sole sections to configure a customized shoe sole. In such embodiments, a user may decide to arrange a sole with cleats only on certain portions of the sole, different surface geometries on certain portions of the sole, and/or different materials on different portions of the sole to obtain unique performance properties, which may be suitable for different kinds of surfaces. In other embodiments, a user may replace a worn out detachable sole portion with a new portion.

In one embodiment, detachable sole section 302 includes at least one means for connecting 306 detachable sole section 302 to a shoe (as shown in FIG. 2, with reference to numeral 200). Means for connecting 306 may be any kind of means for connecting two objects, such as, but not limited to, zippers, magnets, clips, suction cups, rods, screws, tacks, nails, hooks and loops fasteners, sticky tack, and the like. In some embodiments, means for connecting 306 may be positioned on the shoe (as shown in FIG. 2) and/or detachable sole section 302. In other embodiments, means for connecting 306 may be independent, e.g. not connected, to either the shoe or the detachable sole section 302.

Referring now to FIGS. 7A through 8B, a means for connecting 700 a shoe 702 and a sole 704, such as a detachable sole or detachable sole section, is shown. Means for connecting 700 may be used to connect any kind of shoe to any kind of sole, including the various embodiments of shoes and detachable soles and sole sections described above and elsewhere throughout the present disclosure.

Figure 7A:
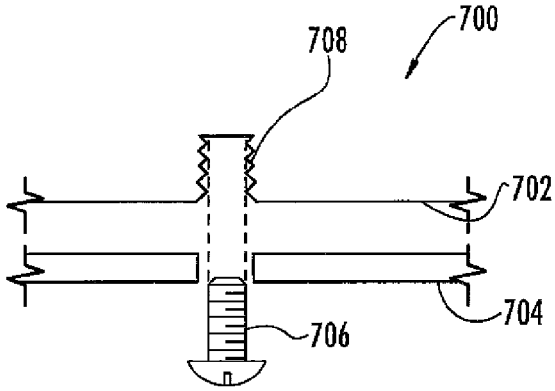
FIGS. 7A through 7C show a connecting means in accordance with various embodiments.
Figure 8A:
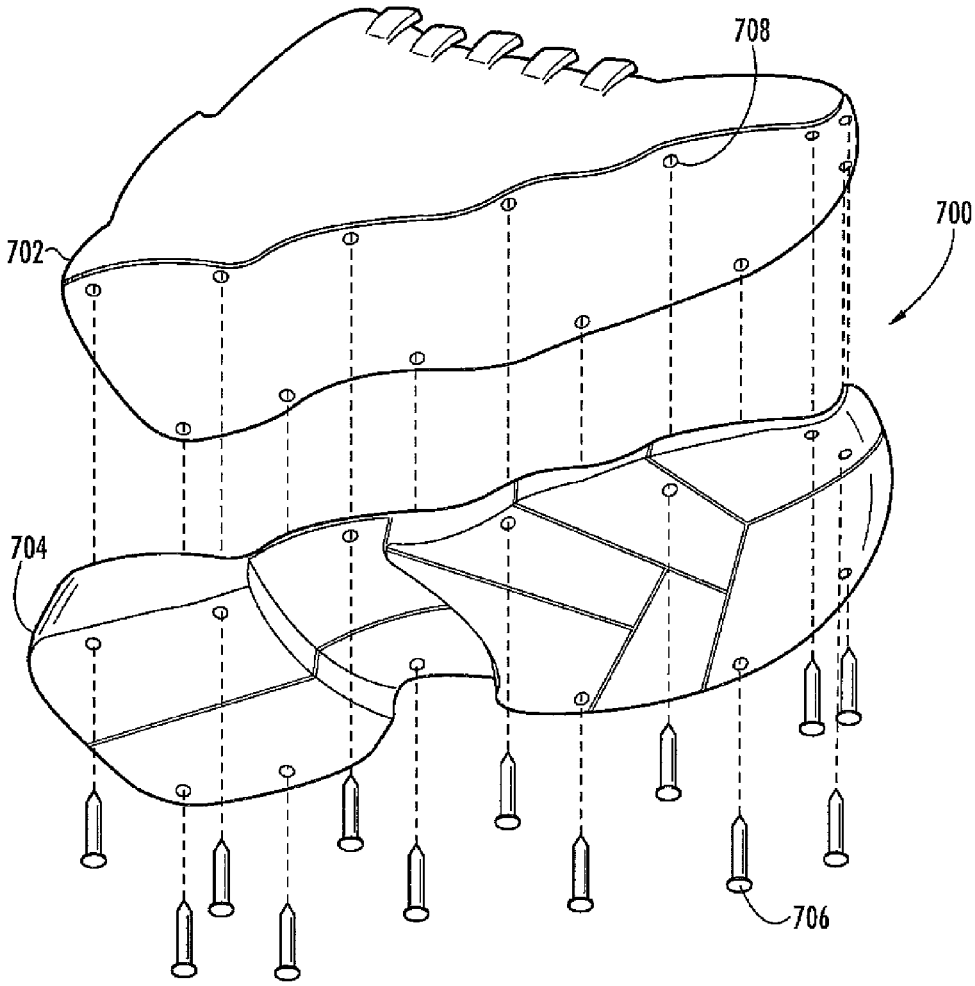
FIGS. 8A and 8B show a connecting means in accordance with various other embodiments.

FIGS. 7A and 8A shows one embodiment of means 700, wherein means 700 comprises at least one screw 706 and socket 708 (which may be located in shoe 702), wherein sole or sole section 704 is held against shoe 702 by screw 706. In an alternate embodiment, screw 706 may actually be a nail (not shown), or a clip (not shown).

Figure 7B:
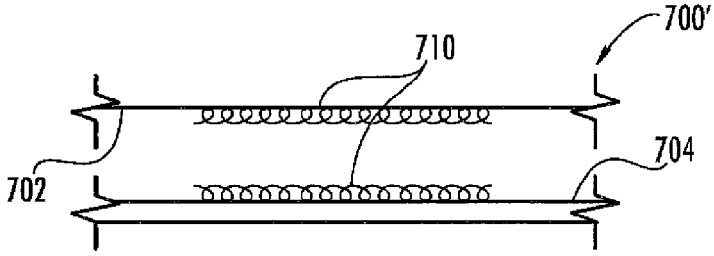

FIG. 7B shows means 700 in accordance with another embodiment, wherein means 700 comprises at least one hooks and loop fastener 710. Shoe 702 may be connected to sole or sole section 704 by pressing the two together, thereby engaging hooks and loop fastener 710. The hooks portion of fastener 710 may be positioned on shoe 702 and/or sole or sole section 704. The loops portion of fastener 710 may be positioned on shoe 702 and/or sole or sole section 704. Hooks and loops fastener 710 may be any type of hooks and loop fastener, such as those sold under the trademark VELCRO®.

Figure 7C:
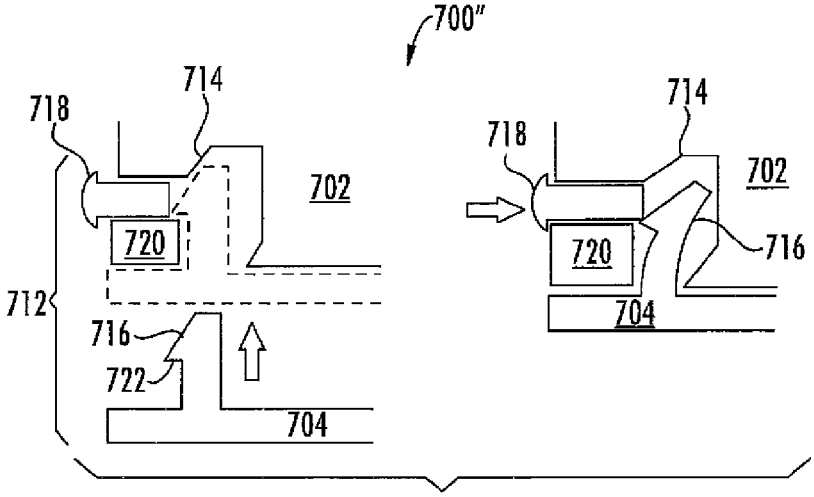

FIG. 7C shows means 700 in accordance with yet another embodiment, wherein means 700 comprises at least one lock and release clip 712, wherein clip 712 may include a female portion 714 and a male portion 716, which is insertable into female portion 714. Female portion 714 may be positioned in shoe 702, and/or sole or sole portion 704. Male portion 716 may be positioned on shoe 702 and/or sole or sole portion 704. In some embodiments, male portion 716 may lockingly engage with female portion 714, as shown by the dotted outline in FIG. 7C. Such a locking engagement may be achieved by having male portion 716 clip into female portion 714, by providing a locking edge 720 in female portion 714 against which a protruding edge 722 on male portion 716 may rest. In a further embodiment, means 700 may include a release means 718, wherein release means may be, but is not limited to, a button that releases means 700, such as by forcing male portion 716 out of its locked position in female portion 714, as shown in FIG. 7C. Such forcing may include pushing protruding edge 722 out of engagement with locking edge 720, as shown in FIG. 7C.

Figure 8B:
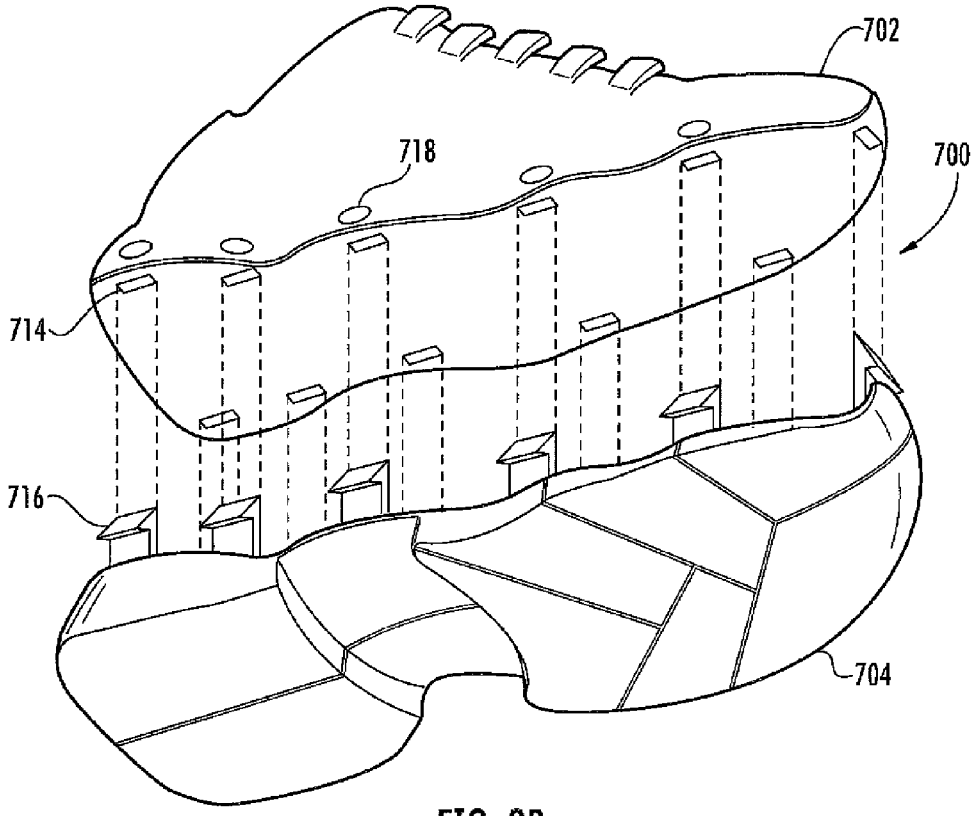

In a further embodiment, connecting means 700 may be positioned anywhere on sole section 704 or shoe 702, such as the periphery of shoe 702, as shown in FIGS. 8A and 8B, or a long an inner portion. In another embodiment, a plurality of connecting means 700 may be positioned along the periphery of each sole section 704, so as to ensure that sole section 704 is securely connected to shoe 702. In other embodiments, connecting means 700 may be positioned along the interior of each sole section 704, for further security.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A kit comprising:

a. at least one shoe;

b. a plurality of detachable sole sections, wherein each detachable sole section is operative to be detachably connected to the at least one shoe; and c. a means for connecting the at least one shoe to the plurality of detachable sole sections, wherein the means or connecting the at least one shoe to the plurality of detachable sole sections is formed to arrange the plurality of detachable sole sections into a single continuous sole when they are connected to the at least one shoe, wherein the means for connecting the at least one shoe to the plurality of detachable sole sections comprises a plurality of lock and release clip mechanisms, wherein the lock and release clip mechanism comprises at least one male portion on each of the plurality of detachable sole sections, and a plurality of female portions positioned on a bottom of the at least one shoe, wherein each of the plurality of male portions is insertable into a corresponding female portion on the bottom of the at least one shoe, and wherein each female portion comprises a locking edge, and each male portion comprises a protruding edge, wherein the protruding edge on each male portion is formed to rest on the locking edge of each corresponding female portion when the male portion is inserted into the female portion.

2. The kit of claim 1, further comprising a plurality of release mechanisms positioned on the shoe, wherein each release mechanism comprises a means for pushing a protruding edge of a male portion off of a locking edge on a female portion.

3. The kit of claim 1, wherein the plurality of detachable sole sections together form a single, continuous sole when the plurality of detachable sole sections are connected to the shoe.

4. The kit of claim 1, further comprising at least one cleat positioned on at least one of the plurality of detachable sole sections.

5. An article of footwear comprising:

a. a shoe; and b. at least one means for connecting the shoe to a plurality of detachable sole sections, wherein the means for connecting the shoe to the plurality of detachable sole sections comprises a plurality of female portions positioned on a bottom of the shoe, wherein each of the plurality of female portions is operative to insertably receive a male portion on a corresponding detachable sole section, and wherein each female portion comprises a locking edge formed to have a protruding edge on each male portion rest on the locking edge of each corresponding female portion when the male portion is inserted into the corresponding female portion.

6. The article of footwear of claim 5, further comprising a plurality of release mechanisms positioned on the shoe, wherein each release mechanism comprises a means for pushing a protruding edge of a male portion off of a locking edge on a female portion.

7. The article of footwear of claim 5, wherein the shoe comprises a stabilizer positioned below an upper of the shoe.

8. The article of footwear of claim 5, wherein the means for connecting the shoe to plurality of detachable sole sections is formed to arrange plurality of detachable sole sections into a single, continuous sole when the plurality of detachable sole sections are connected to the shoe.

9. The article of footwear of claim 5, further comprising a plurality of detachable sole sections connected to the shoe, wherein the plurality of detachable sole sections together form a single, continuous sole when connected to the shoe.

10. An apparatus comprising: a plurality of detachable sole sections, wherein each detachable sole section is operative to be detachably connected to at least one shoe, and wherein each of the plurality of detachable sole sections includes at least one means for connecting the respective detachable sole section to a shoe, wherein the means for connecting the respective detachable sole section to a shoe comprises at least one male portion on each of the plurality of detachable sole sections, wherein each of the male portions is operative to be inserted into a corresponding female portion on a bottom of a shoe, and wherein each of the male portions comprises a protruding edge formed to rest on a locking edge in each of the corresponding female portions when each male portion is inserted into corresponding the female portion.

11. The apparatus of claim 10, wherein the plurality of detachable sole sections together form a single, continuous sole when the plurality of detachable sole sections are connected to the shoe.

12. The apparatus of claim 10, further comprising at least one cleat positioned on at least one of the plurality of detachable sole sections.

* * * * *